US006145526A

United States Patent [19]

Quiring et al.

[11] Patent Number: 6,145,526

[45] Date of Patent: Nov. 14, 2000

[54] TIE-DOWN SYSTEM FOR FABRIC COVERED BUILDINGS

[75] Inventors: Richard Quiring; Nathan Stobbe, both of Saskatoon, Canada

[73] Assignee: Cover-All Shelter Systems, Saskatchewan, Canada

[21] Appl. No.: 09/033,185

[22] Filed: Mar. 2, 1998

[30] Foreign Application Priority Data

Jan. 13, 1998 [CA] Canada ..... 2226787

[51] Int. Cl.[7] ..... E04H 15/32

[52] U.S. Cl. ..... 135/120.3; 135/115; 135/119; 135/120.2; 135/125; 135/906; 135/908; 160/329; 160/368.1; 52/2.25; 52/63; 52/222; 24/468

[58] Field of Search ..... 135/124, 115, 135/119, 117, 908, 906, 125, 120.2, 120.3, 120.1; 52/63, 83, 86, 222, 2.25; 160/327, 728, 329, 354, 368.1; 24/465, 468

[56] References Cited

U.S. PATENT DOCUMENTS

| | | | |
|---|---|---|---|
| 3,116,746 | 1/1964 | Bird . | |
| 3,162,920 | 12/1964 | Durham . | |
| 3,886,961 | 6/1975 | Geiger et al. | 135/1 R |
| 4,195,651 | 4/1980 | Watts et al. | 135/2 |
| 4,858,395 | 8/1989 | McQuirk . | |
| 5,269,106 | 12/1993 | Stafford et al. . | |
| 5,311,699 | 5/1994 | Huffman . | |
| 5,315,736 | 5/1994 | Nilsson | 24/115 |
| 5,579,794 | 12/1996 | Sporta . | |
| 5,901,726 | 5/1999 | Gal et al. | 135/20.3 |

FOREIGN PATENT DOCUMENTS

| | | |
|---|---|---|
| 2228076 | 1/1974 | Germany . |
| 1625428 A1 | 2/1991 | U.S.S.R. . |

*Primary Examiner*—Carl D. Friedman
*Assistant Examiner*—Yvonne M. Horton
*Attorney, Agent, or Firm*—Adams, Schwartz & Evans, P.A.

[57] ABSTRACT

A system for securing the fabric cover of a fabric covered building to the framework or foundation of the building. Along each side of the fabric cover, a tie-down member is fastened so as to extend substantially from one end of the fabric cover to the opposite end. This member is most conveniently a pipe inserted in pockets formed along the sides of the fabric cover, the member being exposed at intervals by cut-outs in the pockets. A plurality of individually adjustable tensioning devices, such as a winch or come-along, are positioned along each side of the fabric cover and attached at one end to the tie-down member where it is exposed by the cut-outs and attached at the opposite end to the framework or ground anchoring foundation. The tensioning devices exert an adjustable force on the tie-down members in the direction of the ground anchoring foundation.

13 Claims, 4 Drawing Sheets

TIE-DOWN SYSTEM FOR FABRIC COVERED BUILDINGS

This invention deals with the field of fabric covered buildings and in particular with a system of securing the fabric covering of such buildings to the framework or ground anchoring foundation of the buildings.

BACKGROUND

Fabric covered buildings are well known wherein a framework is secured to a ground anchoring foundation and then covered with fabric. Such buildings are economical, fast and easy to erect and maintain, durable and easy to relocate. These features have made fabric covered buildings very popular, and led to demand for ever longer and wider buildings. However, these wider buildings are subject to much higher loads from wind, snow and so forth.

The fabric covering of such buildings is generally secured in two ways. It may be in sections, each of which covers the area between two arches of the framework and is secured along the perimeter of each arch, or the fabric may be a single large piece which is pulled over the framework and attached at each edge to the framework or the foundation.

The present means for securing the fabric to the framework and the foundation is most often by a rope through holes in, or rings attached to, the edge of the fabric covering. The rope most often weaves from holes in the fabric to the framework and back to the fabric and so forth along a side of the building. To tighten the fabric, the rope must be pulled tight and knotted. This method, when used in larger buildings, notably those with a one-piece fabric covering, often fails as the holes in the fabric tear because of the increased stress exerted by wind, snow and so forth.

The tension on the fabric covering must be adjusted periodically to compensate for stretching. The rope must be untied, pulled tighter and re-knotted. This is time-consuming and imprecise, and it is difficult to maintain the required tension while knotting the rope. On the larger buildings contemplated herein, this problem can be particularly acute. Proper tension is necessary to avoid excess movement of the fabric cover due to wind and snow loads, and so forth.

The sides of the fabric where the rope passes is difficult to seal against the weather. The rope is often tied to a board attached to the framework or foundation. This leaves a gap between the fabric and the ground, which gap is often sealed by a wooden construction along the inside of the building, leaving the rope on the outside of the building, exposed to the elements. Often fabric covered buildings are mounted on a stub-wall, in which case the needed sealing construction is already present. In situations where the building is mounted on pilings alone, an improved sealing system would be advantageous. It would also be a benefit to cover the rope or other securing mechanism from the elements.

Truss arches may be utilized to provide the increased strength needed for a larger fabric covered building, however an improved tie-down system would be desirable in order to take advantage of the truss arch strength by increasing the loads to which the fabric cover may safely be subjected.

SUMMARY OF THE INVENTION

It is an object of the present invention to provide a system for securing the fabric covering of fabric covered buildings that is stronger than present systems and which allows for fast and accurate adjustments of the tension on the fabric covering.

It is a further object of the present invention to provide such a system that provides for easier and closer sealing of the fabric to the foundation.

The invention accomplishes these objects providing a system for securing the fabric cover of a fabric covered building comprising a framework for supporting the fabric cover, the framework having two opposite sides, each side being secured to a ground-anchoring foundation and the framework having two opposite ends; a fabric cover over the framework, the fabric cover having two sides and two ends, each side being in proximity to a bottom portion of each side of the framework and each end of the fabric cover being in proximity to each corresponding end of the framework; along each side of the fabric cover, a tie-down member fastened so as to extend substantially from one end of the fabric cover to the opposite end of the fabric cover; and a plurality of individually adjustable tensioning means positioned along each side of the fabric cover, one end of each tensioning means attached to one of the tie-down members and the opposite end of each tensioning means attached to the framework or the ground anchoring foundation, each tensioning means exerting an adjustable force on the tie-down member in the direction of the ground anchoring foundation; wherein the fabric cover is held in place by the tensioning means and wherein the tension exerted on the fabric cover may be adjusted.

Fastening of the tie-down member to the fabric cover is most conveniently accomplished by inserting the tie-down member into a pocket attached to each side of the fabric cover. Cut-outs in the pockets at intervals along their length provide access for attachment of the adjustable tensioning means to the tie-down members. Alternatively the tie down member could be fastened by passing the member through rings or loops attached to the fabric at short intervals so as to maintain an even tension along the side of the fabric cover.

The pockets may be formed and then fastened to the outer edge of the fabric, or formed by folding the outer edge of the fabric cover and fastening the outer edge to the fabric cover along a line parallel to and removed from the outer edge.

The pockets may be formed and fastened by sewing, however the holes in the fabric that result from sewing weaken the fabric. While this is not normally a problem, the increased forces exerted on larger buildings may be such as to cause the sewn pockets to tear along the sewn seams. Heat sealing of the fabric to form the pocket provides a stronger seam with no holes to weaken the fabric at the seam.

The adjustable tensioning means could include a ratchet mechanism to provide the needed adjustable force. Most conveniently a winch is mounted on the piling for each arch, and fastened to the tie-down member.

The tie-down member is most conveniently a tubular member, such as a pipe, which can be made in sections for shipping and then put together on site by pipe connectors or other conventional means. The tie-down member should have sufficient strength to resist bending when subjected, at the pockets, to the required tensioning forces.

The sealing of the gap where the fabric cover meets the foundation is accomplished by heat sealing a sealing flap along each side of the fabric cover which sealing flap extends beyond the outer edge of the cover. The tension exerted on this sealing flap is not critical since the cover tension is maintained by the tensioning means acting on the tensioning member. The sealing flap may then be attached by nails, screws, ropes and so forth to any convenient points on the framework or foundation, or to stakes driven into the ground. The sealing flap may also extend over the ground and be covered with back-fill. A further advantage of such a sealing flap is that the tensioning means are covered and protected from the elements.

To provide the required strength for the wider buildings herein contemplated, truss arches are generally utilized, although the disclosed system and its advantages are appropriate for use in a building of any width. Each truss arch could be attached to a piling, being the ground anchoring foundation.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE EMBODIMENT

The invention provides a system for securing the fabric cover of a fabric covered building comprising a framework for supporting the fabric cover, the framework having two opposite sides, each side being secured to a ground-anchoring foundation and the framework having two opposite ends; a fabric cover over the framework, the fabric cover having two sides, each side being in proximity to the bottom of each side of the framework, and two ends, each end being in proximity to each end of the framework; along each side of the fabric cover, a tie-down member fastened so as to extend substantially from one end of the fabric cover to the opposite end; and a plurality of individually adjustable tensioning means positioned along each side of the fabric cover, attached at one end to one of the tie-down members and attached at the opposite end to the framework or the ground anchoring foundation, the tensioning means exerting an adjustable force on the tie-down member in the direction of the ground anchoring foundation; wherein the fabric cover is held in place by the tensioning means and wherein the tension exerted on the fabric cover may be adjusted.

FIGS. 1–6 show one preferred embodiment of the invention, showing a fabric covered building having a single sheet of fabric pulled over the framework and secured on each side by adjustable tensioning means attached to the fabric cover and to the ground anchoring foundation.

Figure 1:
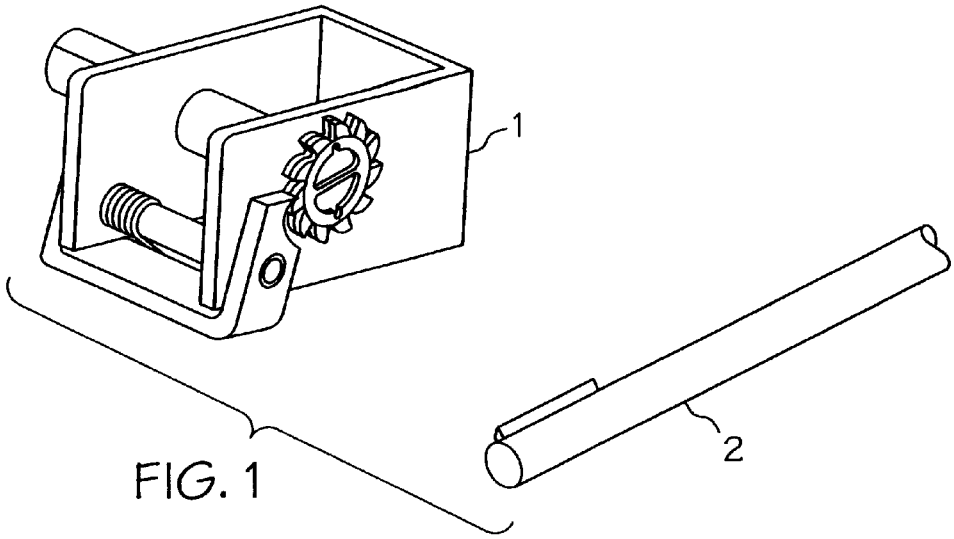
FIG. 1 is a perspective view of the lashing winch.

FIG. 1 shows one embodiment of the invention wherein the adjustable tensioning means is a winch. The lashing winch 1 and detachable handle 2 are shown. The lashing winch 1 comprises a ratchet mechanism in this embodiment, however a winch or come-along using friction clutches or other suitable means is contemplated within the scope of the invention.

Figure 2:
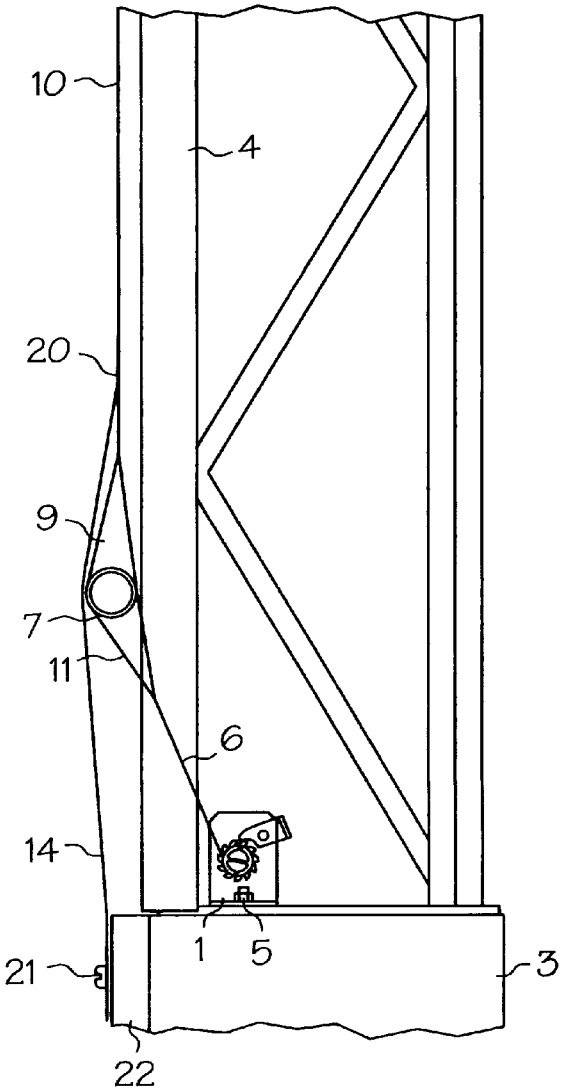
FIG. 2 is a plane end view of the lashing winch mounted to a piling and attached to the tie-down member, and also showing the attachment of the sealing flap to boards along the bottom of the framework.

FIG. 2 shows the lashing winch 1 mounted to the pilings 3 by anchor bolts 5, which anchor bolts 5 also serve to fasten the truss arch 4 to the pilings 3.

Figure 3:
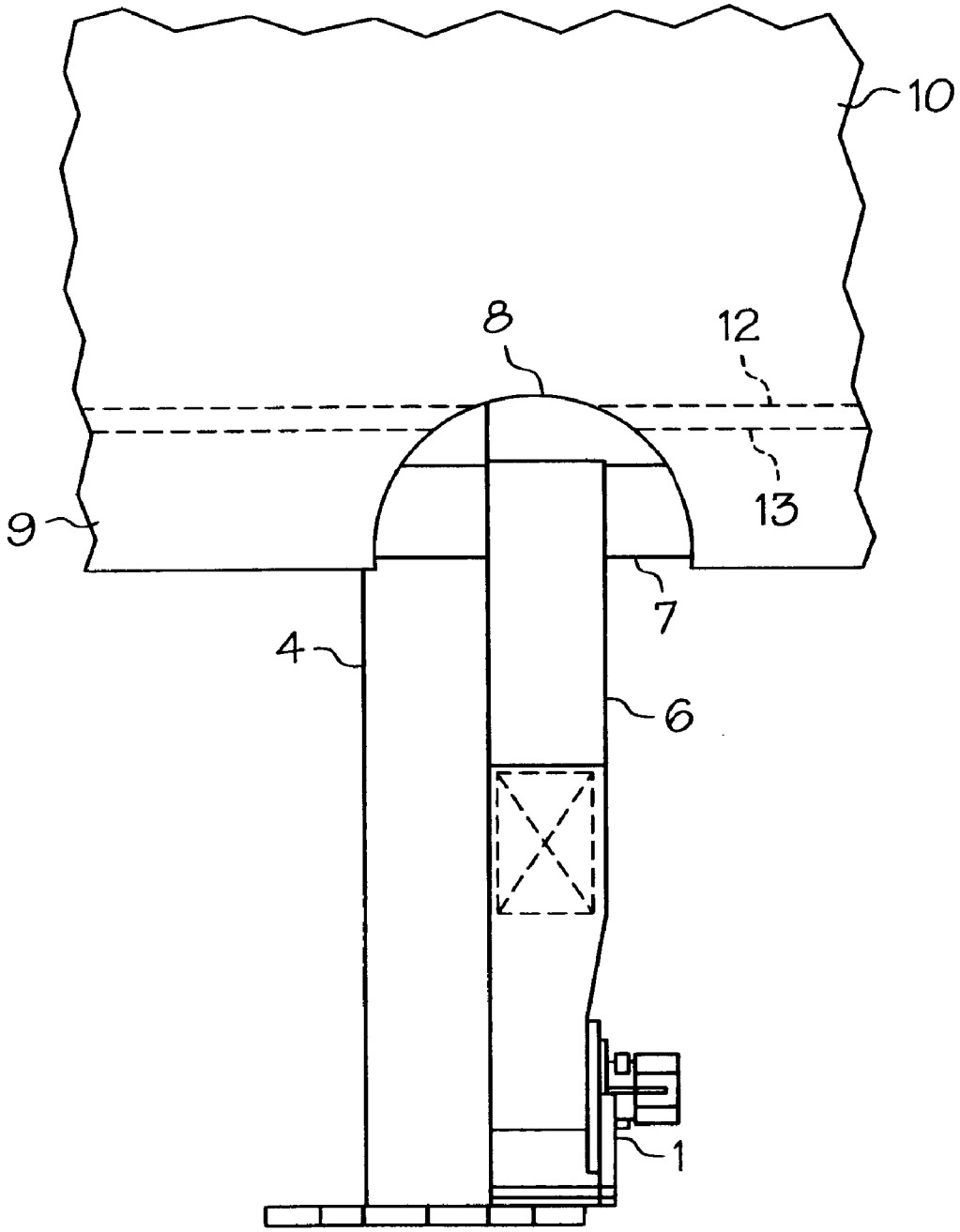
FIG. 3 is a side view showing the lashing straps attached to the tie-down member.

FIG. 3 shows the lashing straps 6 attached to the tie-down member 7 at cut-outs 8 in pockets 9 and fabric cover 10. The tie-down member 7 passes through loops 11 formed at one end of the lashing straps 6. The opposite free end 16 of the lashing straps 6 is attached to the lashing winch 1.

Figure 4:
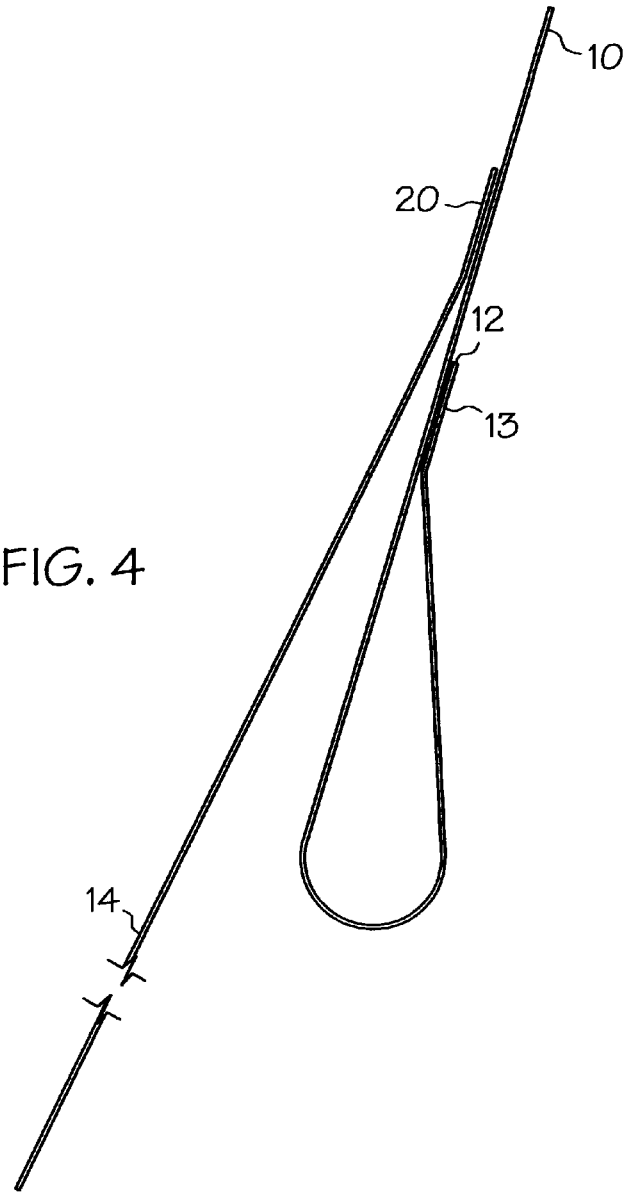
FIG. 4 is an end view showing the construction of the pockets.
Figure 5:
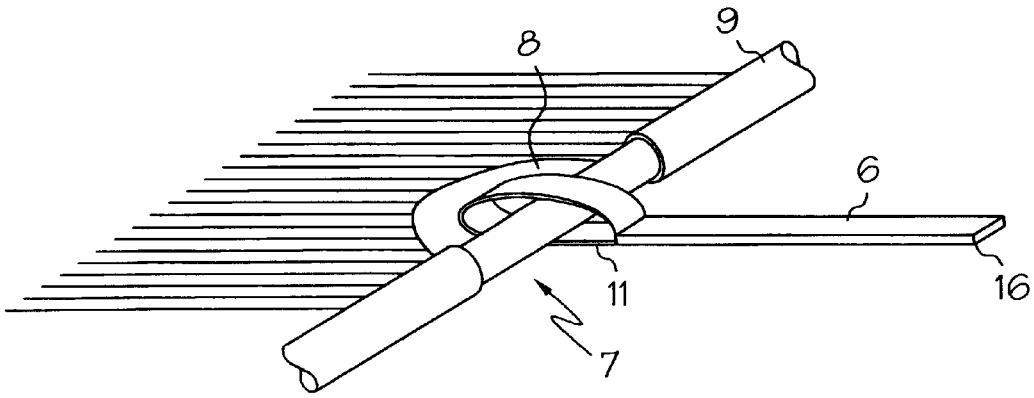
FIG. 5 is a perspective view of the lashing straps attached to the tie-down member and the tie-down member located in the pocket.

FIG. 4 is an end view of the pockets 9 and tie-down member 7, showing that the pocket is formed by folding the outer edge 12 of the fabric cover 10 back and heat sealing the outer edge 12 to the fabric cover 10 at pocket seam 13. Also shown is the attachment of the sealing flap 14 to the fabric cover along a flap seam 20 adjacent to the pocket seam 13. Sewing is an alternative to heat sealing and is contemplated within the scope of this invention, however heat sealing is preferred to sewing as no holes are punctured in the fabric, which holes weaken the fabric. Alternatively the pockets 9 may be formed separately and heat sealed or sewn to the outer edge 12.

Figure 6:
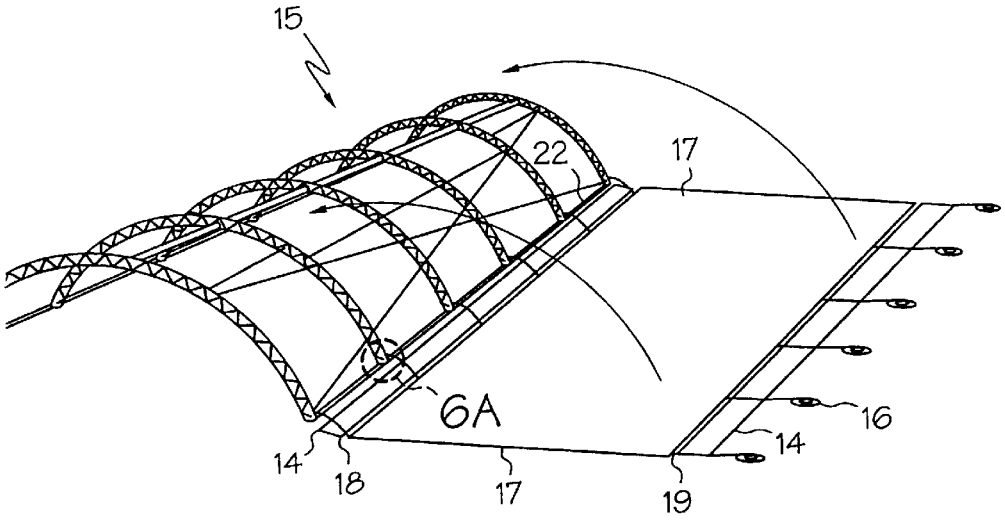
FIG. 6 is a perspective view of the fabric cover laid out prior to installation on the framework of the building.
Figure 7:
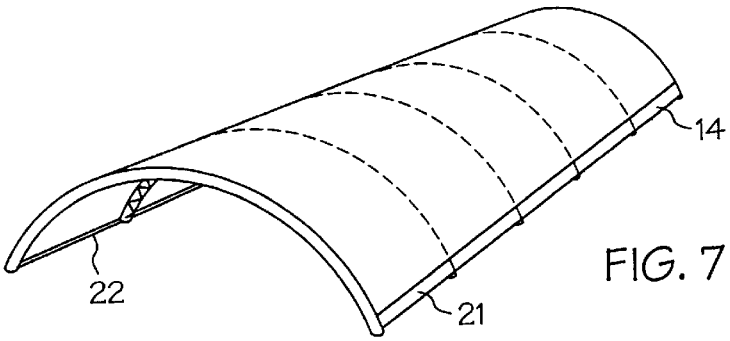
FIG. 7 is a perspective view of the completed building.

FIG. 6 shows the fabric cover 10 laid out on the ground adjacent to the framework 15 of the building, which framework 15 comprises a plurality of truss arches 4. Truss arches are utilized to provide the increased strength needed for a wider building such as that contemplated by this invention.

Fabric cover 10 has two opposite ends 17 and two opposite sides being the first attached side 18 and the second attached side 19. Sealing flaps 20 are heat sealed along each of the sides 18 and 19, and extend beyond the pockets 9. Along the first attached side 18, free ends 16 of lashing straps 6 are attached to the tie-down member 7 by loops 11 and the opposite free ends 16 are attached to lashing winches 1 mounted on each piling 3.

FIG. 6 shows the completed building. The second attached side 19 of the fabric cover 10 is pulled over the framework 15. The second tie-down member 7 is inserted into the pocket 9 and through the loops 11. The free ends 16 of the lashing straps 6 along the second attached side 19 are similarly attached to the lashing winches 1 located along the opposite side of the building.

The ends 17 of the fabric cover 10 are pulled into proper position and secured to the framework 15 by ropes or other conventional means. The lashing winches 1 are then tightened until the proper force is being exerted on the tie-down member 7.

Sealing flaps 14 are secured by screws 21 into boards 22 secured to the pilings 3. Earth is often backfilled over the flaps to make a very close seal. The sealing flaps cover the lashing winches 1, protecting them from the elements.

The illustrated embodiment includes truss arches for added strength, however it is contemplated that the disclosed tie-down system would be advantageous when used with any framework.

Thus it can be seen that the invention accomplishes all of its stated objectives. The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

1. lashing winch
2. detachable handle
3. pilings
4. truss arch
5. anchor bits
6. lashing straps
7. tie-down member/pipe
8. cut-outs
9. pockets
10. fabric cover
11. loops in lashing straps
12. outer edge of the fabric cover
13. pocket seam
14. sealing flap
15. framework
16. free end of the lashing straps
17. ends of fabric cover
18. first attached side of fabric cover
19. second attached side of fabric cover
20. flap seam
21. screws
22. boards

I claim:

1. A system for securing a fabric cover of a fabric covered building comprising:

a framework for supporting the fabric cover, the framework having two opposite sides and two opposite ends, each side for being secured to a ground-anchoring foundation;

a fabric cover supported over the framework, the fabric cover having two sides, each side being in proximity to a bottom portion of each side of the framework, and two ends, each end of the fabric cover being in proximity to each end of the framework;

a pocket attached along each side of the fabric cover;

a tie-down member inserted in the pocket and extending substantially from one end of the fabric cover to the opposite end of the fabric cover; and a plurality of individually adjustable tensioning means positioned along each side of the fabric cover, one end of each tensioning means attached to one of the tie-down members and the opposite end of each tensioning means adapted for attachment to at least one of the framework or the ground anchoring foundation, each tensioning means exerting an adjustable force on the tie-down member in the direction of the ground anchoring foundation;

wherein the fabric cover is held in place by the tensioning means and wherein the tension exerted on the fabric cover is adjustable.

2. The system of claim 1 wherein the pockets are formed by folding an outer edge of a side of the fabric cover and fastening the outer edge to the fabric cover along a line parallel to and removed from the outer edge.

3. The system of claim 1 wherein the pockets further include cut-outs at intervals along the length of the pockets, the cut-outs causing the tie-down member to be exposed and accessible for attachment of the adjustable tensioning means.

4. The system of claim 3 wherein the cut-outs extend beyond the pocket into the fabric cover.

5. The system of claim 2 wherein the fastening of the outer edge of the fabric cover to the fabric cover to form a pocket is by heat sealing.

6. The system of claim 2 wherein the fastening of the outer edge of the fabric to the fabric to form a pocket is by sewing.

7. The system of claim 1 wherein the adjustable tensioning means comprises a ratchet.

8. The system of claim 1 wherein the tie-down member comprises a pipe.

9. The system of claim 1 wherein the fabric cover further includes a sealing flap attached to each side of the fabric cover and extending beyond the outer edges of the fabric cover.

10. The system of claim 7 comprising fastening means for fastening the sealing flaps to the framework or ground.

11. The system of claim 9 wherein the sealing flap is attached to the fabric cover by heat sealing.

12. The system of claim 9 wherein the framework comprises a plurality of truss arches in spaced side by side alignment, each truss arch anchored to a piling, the piling being the ground anchoring foundation.

13. The system of claim 12 wherein the adjustable tensioning means is a winch attached to each piling.

* * * * *